US011408131B2

(12) United States Patent
Herzog et al.

(10) Patent No.: US 11,408,131 B2
(45) Date of Patent: Aug. 9, 2022

(54) TRACK-LIFTING AND BALLAST-SPREADING APPARATUS

(71) Applicant: Herzog Railroad Services, Inc., St. Joseph, MO (US)

(72) Inventors: Jacob D. Herzog, St. Joseph, MO (US); Tony Shirk, Clarksdale, MO (US); Daniel T. Marshall, Leavenworth, KS (US); Steven R. Walton, Olathe, KS (US); Derek DeMott, Maryville, MO (US)

(73) Assignee: Herzog Railroad Services, Inc., St. Joseph, MO (US)

( * ) Notice: Subject to any disclaimer, the term of this patent is extended or adjusted under 35 U.S.C. 154(b) by 289 days.

(21) Appl. No.: 16/850,663

(22) Filed: Apr. 16, 2020

(65) Prior Publication Data

US 2020/0340187 A1 Oct. 29, 2020

Related U.S. Application Data

(60) Provisional application No. 62/838,764, filed on Apr. 25, 2019.

(51) Int. Cl.

| | |
|---|---|
| ***E01B 27/02*** | (2006.01) |
| ***E01B 29/04*** | (2006.01) |
| ***E01B 27/17*** | (2006.01) |

(52) U.S. Cl.

CPC ..... *E01B 27/023* (2013.01); *E01B 27/022* (2013.01); *E01B 29/04* (2013.01); *E01B 27/17* (2013.01)

(58) Field of Classification Search

CPC ..... E01B 27/17; E01B 27/022; E01B 27/023; E01B 29/04

See application file for complete search history.

(56) References Cited

U.S. PATENT DOCUMENTS

| | | | | |
|---|---|---|---|---|
| 785,252 A | | 3/1905 | Cravens | |
| 2,271,311 A | | 1/1942 | Shambaugh | |
| 2,725,016 A | * | 11/1955 | Fogelberg | E01B 27/04 37/104 |
| 3,153,390 A | * | 10/1964 | Plasser | E01B 27/17 104/12 |
| 3,435,779 A | | 4/1969 | Stewart | |

(Continued)

FOREIGN PATENT DOCUMENTS

RU 162030 U1 5/2016

*Primary Examiner* — Jessica H Lutz

(74) *Attorney, Agent, or Firm* — Avek IP, LLC; Kent R. Erickson

(57) ABSTRACT

A rail-lifting and ballast-spreading apparatus that may be employed to rehabilitate damaged tracks or aid rough in of new tracks, is described. The apparatus includes a track-lifting unit at a forward end thereof that includes an arm that is pivotable to extend forwardly and over a section of track in need of repair or ballast replenishment. Rail clamps are provided on a distal end of the arm that engage and travel along the rails as the apparatus moves forward. A conveyor provides a stream of ballast across the width of the tracks while the tracks are lifted and as the apparatus moves forward onto the now repaired tracks. A surge bin is provided to increase a rate of distribution of the ballast material by the conveyor over that available from the ballast-delivery consist.

20 Claims, 9 Drawing Sheets

(56) References Cited

U.S. PATENT DOCUMENTS

| | | | | | |
|---|---|---|---|---|---|
| 3,455,249 | A | | 7/1969 | Stewart | |
| 3,635,164 | A | | 1/1972 | Patton | |
| 3,685,589 | A | * | 8/1972 | Plasser | E01B 27/105 171/16 |
| 3,976,142 | A | * | 8/1976 | Plasser | E01B 27/028 104/2 |
| 4,136,618 | A | | 1/1979 | Boyer | |
| 4,267,777 | A | * | 5/1981 | Theurer | E01B 27/105 404/101 |
| 4,430,944 | A | * | 2/1984 | Theurer | E01B 27/105 104/2 |
| 4,457,234 | A | | 7/1984 | Theurer et al. | |
| 4,565,133 | A | | 1/1986 | Moore | |
| 5,090,483 | A | * | 2/1992 | Theurer | E01B 27/026 37/104 |
| 5,119,723 | A | | 6/1992 | Lovitt, Jr. | |
| 5,297,482 | A | | 3/1994 | Cleveland | |
| 5,479,725 | A | * | 1/1996 | Theurer | E01B 27/105 37/104 |
| 6,058,628 | A | * | 5/2000 | Theurer | E01B 27/023 104/2 |
| 6,453,822 | B2 | | 9/2002 | Theurer et al. | |
| 6,637,133 | B2 | * | 10/2003 | Theurer | E01B 27/105 37/104 |
| 7,258,069 | B1 | | 8/2007 | Cotsford | |
| 9,121,140 | B2 | | 9/2015 | Conner, Jr. | |
| 9,382,668 | B2 | * | 7/2016 | Ibañez Latorre | E01B 27/023 |
| 10,358,150 | B2 | * | 7/2019 | Carter | E01B 27/16 |
| 2007/0095242 | A1 | | 5/2007 | Pike | |
| 2016/0273171 | A1 | | 9/2016 | Ibanez Latorre | |

* cited by examiner

TRACK-LIFTING AND BALLAST-SPREADING APPARATUS

CROSS-REFERENCE TO RELATED APPLICATIONS

This application claims the benefit of U.S. Provisional Patent Application No. 62/838,764 filed Apr. 25, 2019 the disclosure of which is hereby incorporated herein in its entirety by reference.

BACKGROUND

Flooding, among other natural disasters and environmental conditions can damage rail infrastructure. For example, ballast material can be washed away from beneath the tracks of the railway by flowing flood waters making the tracks unsafe and impassable by rail traffic. Efforts must be made to quickly restore the tracks to a safe operational state in order for rail traffic to resume with as little disruption as possible.

Replacement of ballast beneath the tracks, i.e. beneath the rails and the rail ties, requires lifting the tracks while depositing new ballast material which is allowed to flow or is maneuvered beneath and around the rail ties. One known method for such repair operations employs multiple lifting devices, such as excavators, tractors, or similar apparatus that are moved alongside the rails. A boom on the excavator is chained to a rail tie to lift the tracks vertically and/or horizontally to realign the tracks. A ballast spreading vehicle is then moved along the rails or alongside the tracks to deposit ballast material around and beneath the lifted portion of the tracks. The multiple excavators must be detached from the tracks and moved along the track in a leapfrog fashion as the ballast spreading vehicle nears or overcomes their respective positions.

Specialized rail cars configured to lift tracks while also depositing ballast therearound are also available. These cars include a forward and rearward truck with a body extending therebetween. The body includes a raised central portion with a lifting apparatus disposed thereon. The lifting apparatus thus lifts or raises the tracks from between the forward and rearward trucks while ballast is deposited therearound. Such a configuration may work well for minor repair and replenishment activities on track that is not substantially damaged. However, such an apparatus is not useable where the track has been substantially washed out and the tracks are impassable or incapable of supporting the apparatus. Use of such a car would require the forward truck to be driven on the damaged and washed out track which may further damage the track and make the car unstable, unsafe, and susceptible to derailment.

SUMMARY

Exemplary embodiments are defined by the claims below, not this summary. A high-level overview of various aspects thereof is provided here to introduce a selection of concepts that are further described in the Detailed-Description section below. This summary is not intended to identify key features or essential features of the claimed subject matter, nor is it intended to be used in isolation to determine the scope of the claimed subject matter. In brief, this disclosure describes a rail-lifting and ballast-spreading apparatus that is useable to repair severely damaged and/or undermined railway track while traveling on useable or repaired portions of said damaged track.

In one embodiment, the apparatus includes a spreading conveyor, a plow, and a track-lifting unit disposed on a rail car. The spreading conveyor is configured to extend longitudinally along the car and to deposit ballast in front of the car's path along the tracks. The spreading conveyor may be narrower than the tracks or ties and/or provide a stream of ballast material that is narrower than the width of the ties or the spreading conveyor may be provided with a wider belt configuration that can provide a stream of ballast that is wider than the spacing of the rails or that is as wide or nearly as wide as or wider than the ties beneath the rails. The spreading conveyor may be moveable transversely side-to-side to direct the ballast material across the width of the ties. In one embodiment, multiple conveyors may be employed and each directed toward a different area across the width of the ties. Baffles, chutes, or guides may also be employed to direct the ballast stream or streams.

The plow is provided along a front end of the car and is configured to smooth and spread the deposited ballast as the car moves toward and over the deposited ballast.

In operation, the apparatus is coupled to a leading end of a ballast-delivery consist that includes a plurality of hopper cars containing ballast material. The hopper cars include conveyors configured to move the ballast material forward along the consist and to transfer the ballast material to the ballast-spreading apparatus. The ballast material may be deposited onto an intermediate conveyor on the apparatus or into a surge hopper on the apparatus which transfers the ballast material to the spreading conveyor. The spreading conveyor then transports and deposits the ballast material on the tracks in front of the car.

In one embodiment, the track-lifting unit comprises a pair of arms coupled to a front end of the apparatus and pivotable between an operational position in which the arms are extended forward from the front end of the car and a transit position in which the arms are pivoted to substantially overlie the car. The arms may be foldable onto themselves and/or telescopic to aid storage thereof during travel as well as for positioning thereof to engage the rails during a repair operation. In another embodiment, only a single arm is provided and includes an end-arm tool disposed at a distal end thereof that is configured to engage both rails. The single arm may comprise a boom of an excavator, loader, or similar apparatus mounted on the apparatus. In such embodiments, the excavator-type apparatus may be provided on a platform that can be raised and lowered to reduce vertical clearance of the apparatus during transit.

In one embodiment, a pair of rail clamps are disposed on a cross-member extending between distal ends of the arms. The rail clamps are coupleable to the rails, such as by gripping heads of the rails and may include rollers, bearings, or other features that allow the clamps to move along the rails as the apparatus moves along the track. The clamps are independently extendable/retractable from the cross-member to enable engagement with rails that are not level and/or to enable lifting of the rails to a desired uneven orientation, such as on a banked curve.

In use, the track-lifting unit is deployed to the operational position and the rail clamps are coupled to the rails. The apparatus is driven along the rails toward the location of the damaged tracks or other area in need of ballast material. The track-lifting unit lifts and maintains the rails and ties attached thereto in a desired position as ballast material is deposited onto the tracks. The apparatus continues forward movement over the damaged section of track with the plow spreading out and dispersing the deposited ballast. The apparatus is thus enabled to continuously repair and travel onto the repaired track until reaching the end of the damaged section without need for additional equipment or machinery to raise or maneuver the damaged track.

In one embodiment, a track-lifting and ballast-spreading apparatus that includes a car body, a track-lifting unit, a rail clamp assembly, and a conveyor is described. The car body is supported on a forward truck and a rearward truck that are configured to travel along a railway. The track-lifting unit is disposed on the car body near the forward truck and includes an arm that is extendable beyond a forward end of the car body to an operational position and retractable to a transit position in which the arm substantially overlies the car body. The rail clamp assembly is disposed at a distal end of the arm and is configured to couple to one or both rails of a section of track to be lifted and to be moveable longitudinally along the rails while maintaining the track in a raised position. The conveyor is disposed on the car body and is configured to distribute ballast material between the forward end of the car body and the rail clamp assembly when the arm is in the operational position and the rail clamp assembly is coupled to the one or both rails. In one embodiment, the conveyor extends or runs below a power unit or base of the track lifting unit.

In another embodiment, a method for distributing ballast material around tracks of a railway is described. A track-lifting and ballast-spreading apparatus coupled to a forward end of a ballast-delivery consist on tracks of a railway in need of ballast material is provided. The apparatus includes a track-lifting unit with an arm, a surge bin configured to receive ballast material from the ballast-delivery consist, and a conveyor configured to receive the ballast material from the surge bin and to transfer the ballast material forwardly along the apparatus. A rail clamp assembly disposed at a distal end of the arm is engaged with one or both rails of the track. The arm is positioned to extend forwardly along the tracks from the track-lifting unit and the rail clamp assembly engages the one or both rails in front of the apparatus. The arm is pivoted vertically by the track-lifting unit to lift the track to a desired raised position. The ballast material is deposited in front of the apparatus by the conveyor while the track is lifted and held in the raised position. The ballast material is distributed onto the now raised track to flow below and around the raised track. The apparatus is moved forwardly along the tracks while maintaining the track in the raised position. The rail clamp assembly maintains the engagement with the one or both rails and moves forwardly along the one or both rails while the apparatus moves onto and over the raised track and the ballast material that has been deposited.

In another embodiment, a track-lifting and ballast-spreading apparatus that includes a car body supported on a forward truck and a rearward truck configured to travel along a railway, a track-lifting unit, a rail clamp assembly, a surge bin, and a conveyor. The track-lifting unit is disposed on the car body near the forward truck and includes an arm, mounted on a power unit or base, that is extendable beyond a forward end of the car body to an operational position and retractable to a transit position in which the arm extends rearwardly and substantially overlies the car body. The power unit of the track-lifting unit is rotatable about a vertical axis to move the arm between the operational position and the transit position. The rail clamp assembly is disposed at a distal end of the arm and is configured to couple to one or both rails of a section of track to be lifted to a raised position and to be moveable longitudinally along the rails while maintaining the track in the raised position. The surge bin is configured to receive a flow of a ballast material from a ballast-delivery consist. The conveyor is disposed on the car body and is configured to receive the ballast material from the surge bin. The conveyor distributes the ballast material between the forward end of the car body and the rail clamp assembly while the track is lifted to the raised position.

DESCRIPTION OF THE DRAWINGS

Illustrative embodiments are described in detail below with reference to the attached drawing figures, and wherein.

DETAILED DESCRIPTION

Figure 1:
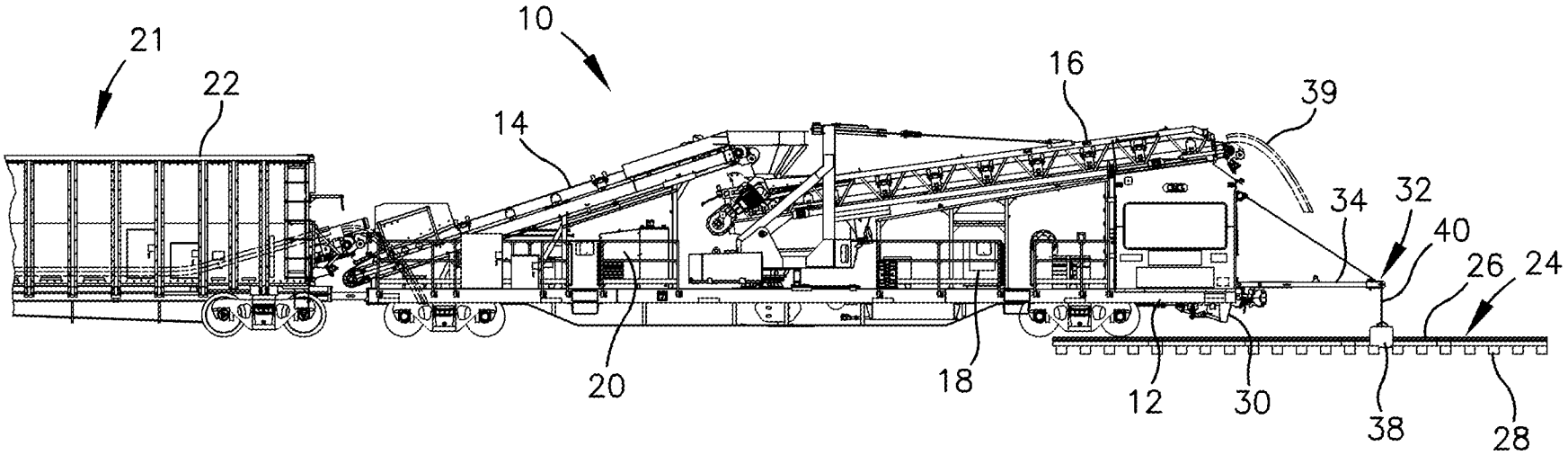
FIG. 1 is side elevational view of a track-lifting and ballast-spreading apparatus depicted in accordance with an exemplary embodiment.
Figure 2:
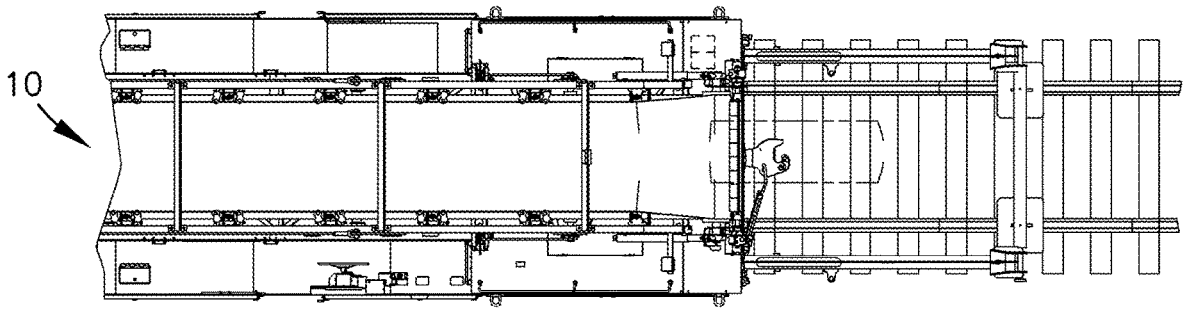
FIG. 2 is an enlarged, partial, top plan view of the apparatus of FIG. 1.
Figure 3:
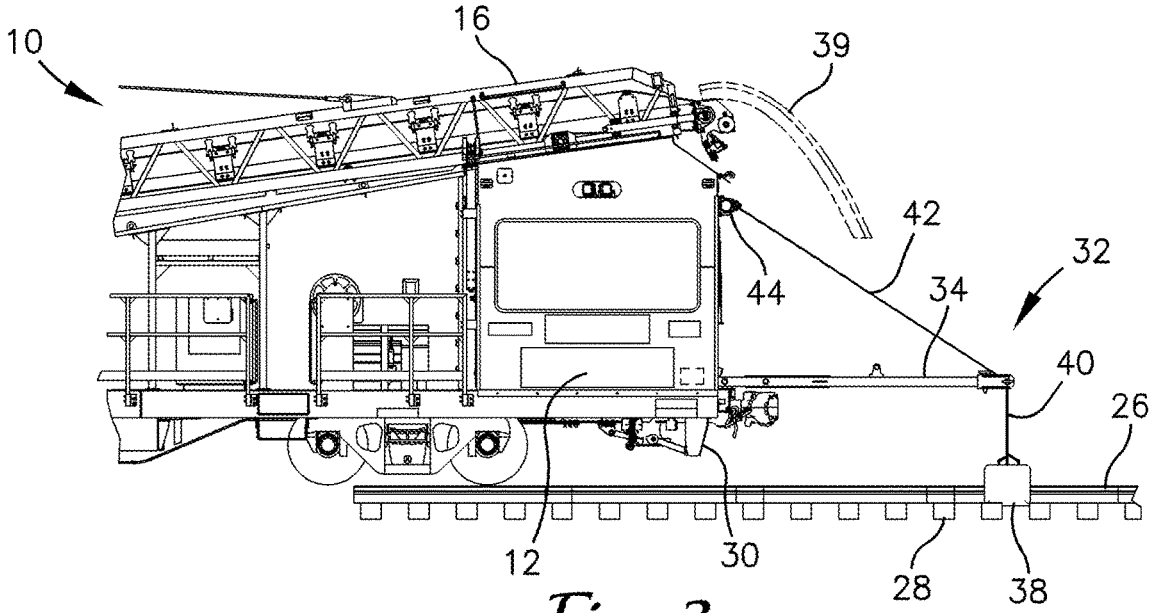
FIG. 3 is an enlarged, partial, side elevational view of the apparatus of FIG. 1.
Figure 4:
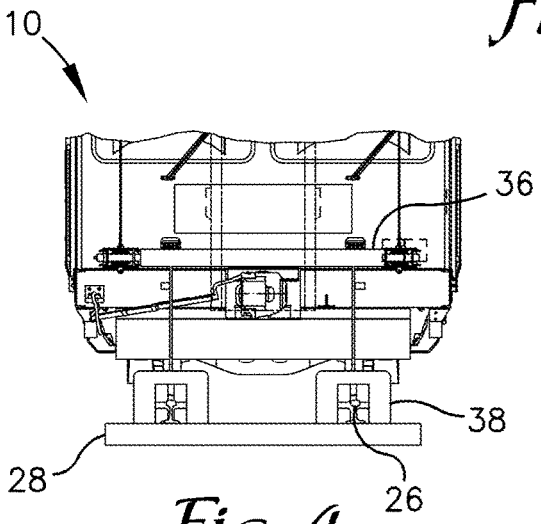
FIG. 4 is a partial front-end elevational view of the apparatus of FIG. 1.
Figure 5:
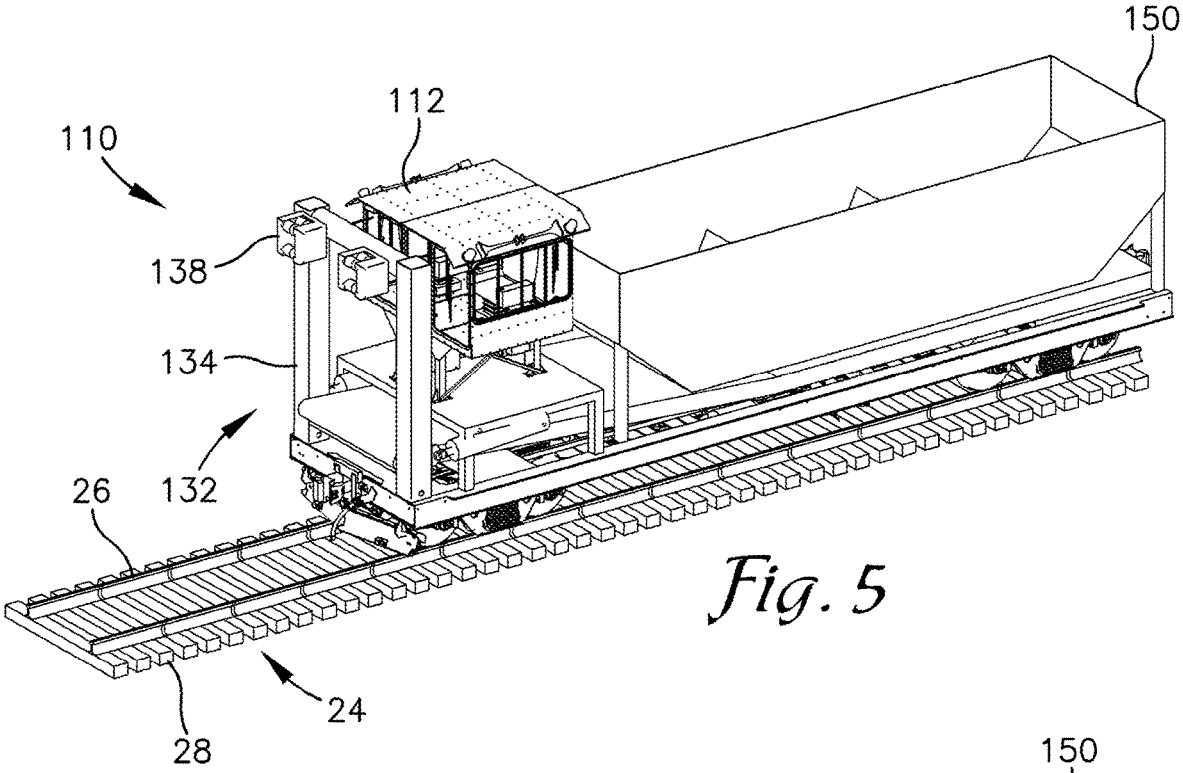
FIG. 5 is a perspective view of a track-lifting and ballast-spreading apparatus depicted in accordance with another exemplary embodiment.
Figure 6:
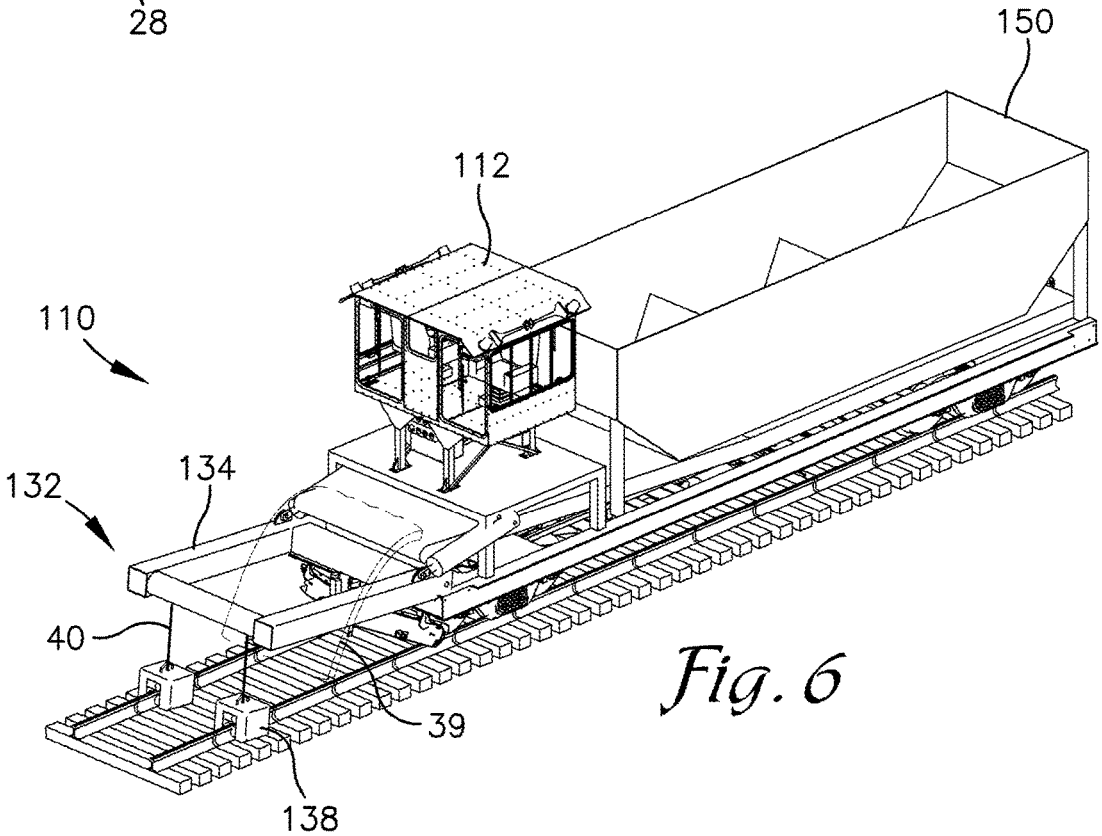
FIG. 6 is a perspective view of the apparatus of FIG. 5 with a track-lifting unit in an extended or lifting position depicted in accordance with an exemplary embodiment.

The subject matter of select exemplary embodiments is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about" or "approximately" or "substantially" as used herein denote deviations from the exact value by +/−10%, preferably by +/−5% and/or deviations in the form of changes that are insignificant to the function.

With reference to FIGS. 1-4, a track-lifting and ballast-spreading apparatus 10 is described in accordance with an exemplary embodiment. Exemplary embodiments are described herein with respect to the drawings in which reference numerals are employed to identify particular components or features. Similar elements in the various embodiments depicted are provided with reference numerals having matching second and third digits but with differing first digits, e.g. element 10 is similar to elements 110, 210, etc. Such is provided to avoid redundant description of similar features of the elements but is not intended to indicate the features or elements are necessarily the same.

The track-lifting and ballast-spreading apparatus 10 may be configured, at least in part, substantially similarly to available ballast-spreading apparatus. As such, the apparatus 10 may include a power and control unit 12, an intermediate conveyor 14, an offloading conveyor 16, a generator 18, and a hydraulic pump 20 and may be coupled to a forward end of a ballast-delivery consist 21 that includes a plurality of hopper cars 22, among other cars. The ballast-delivery consist 21 may be of the type disclosed in U.S. Pat. No. 9,346,473 assigned to Herzog Railroad Services, Inc. and incorporated herein by reference. The power and control unit 12 includes one or more control surfaces, computers, displays, and the like to enable an operator to control operation of components disposed on the apparatus 10 as well as on hopper cars 22 coupled to the rearward end of the apparatus 10. It is also foreseen that control and operation of the components disposed on the apparatus 10 and hopper cars 22 may be controlled remotely. As used herein reference to a forward end of the track-lifting and ballast-spreading apparatus 10 corresponds to the end from which ballast is discharged by the conveyor 16. The rearward end of apparatus 10 is the end proximate the ballast-delivery consist 21.

The intermediate conveyor 14 is positioned near a rearward end of the apparatus 10 and extends at an upward angle toward the forward end of the apparatus 10. The rear end of the intermediate conveyor 14 is configured to be at least partially longitudinally overlapped by a conveyor disposed on the hopper car 22 located immediately aft of the apparatus 10 and may extend beyond the rear end of the apparatus 10. A scale or other weighing device may be disposed on or integrated with the intermediate conveyor 14 to measure the weight of ballast materials being transported thereby. The forward end of the intermediate conveyor 14 is supported above an intake end of the offloading conveyor 16. A chute or other housing may be provided at the forward end of the intermediate conveyor 14 to direct the ballast materials thereon onto the underlying offloading conveyor 16.

The offloading conveyor 16 may be rotatably and pivotably mounted on the apparatus 10. The intake end of the offloading conveyor 16 is coupled to a rotatable support structure located generally centrally along the length of the apparatus 10. The offloading conveyor 16 is configured to offload ballast materials in front of the apparatus 10 and may be rotatable side-to-side any desired angle to either side of the apparatus 10. The support structure is preferably sufficiently rotatable to enable depositing ballast material across a full width of tracks 24 on which the apparatus 10 is positioned (including rails 26 and ties 28 which make up the tracks 24) but may be further rotatable up to or further than about 180° side-to-side to enable offloading of ballast materials on either side of the apparatus 10. The offloading conveyor 16 extends from the support structure in a cantilevered fashion and may be at least partially vertically pivotable about the coupling with the support structure to enable raising/lowering of the discharge end of the conveyor 16.

The generator 18 comprises an available generator technology and may be included on the apparatus 10 to provide electrical power for operation of the controls in the power and control unit 12, operation of the intermediate and offloading conveyors 14, 16 and/or operation of the hydraulic pump 20.

The hydraulic pump 20 comprises an available hydraulic pump or hydraulic pressure generation system. The hydraulic pump 20 is configured to provide sufficient hydraulic pressure for operation of actuators included on the apparatus 10 as well as those disposed on the hopper cars 22 and/or any other desired cars in the consist 21. For example, actuators on the apparatus 10 may function to rotate and pivot the offloading conveyor 16 and actuators on the hopper cars 22 may function to open/close gates. Although the pump 20 and associated actuators and systems described herein are termed hydraulic, other systems, such as electronic, mechanical, and pneumatic, among others can be employed. In another embodiment, the hydraulic pump 20 is disposed on another car in the consist 21. Appropriate connections are provided between the apparatus 10, the hopper cars 22, and any other cars in the consist 21 to conduct electricity, hydraulic fluids/pressure, and communications between the cars.

The apparatus 10 includes a plow 30 disposed under the forward end thereof. The plow 30 is configured to push and spread ballast material between and outside of the rails 26 as the apparatus 10 is driven along the tracks 24. The plow 30 may include one or more actuators configured to raise and lower the plow 30 and or to pivot the plow 30 to direct ballast materials to one side or the other of the tracks 24.

The apparatus 10 includes a track-lifting unit 32 disposed at the forward end thereof. The track-lifting unit 32 includes a pair of arms 34 that are pivotably coupled to the body of the apparatus 10 to be pivotable between a generally vertical stowed position and a generally horizontal, forwardly extending lifting position as depicted in FIGS. 1-4. Pivotal movement of the arms 34 may be provided by a cable 42 and winch 44 as depicted in FIGS. 1-4 or may employ one or more hydraulic actuators and/or mechanical linkages, among other configurations. In another embodiment, the arms 34 may be articulated or include one or more joints along their length that enable the arms 34 to at least partially retract or fold onto themselves. The arms 34 might alternatively or additionally include one or more telescoping portions that enable retraction or extension thereof, among other configurations.

A cross-member 36 is disposed to extend between distal ends of the arms 34 and includes a rail clamp assembly comprising a pair of rail clamps 38 suspended therefrom. The arms 34 are preferably spaced transversely apart a distance that is wider than a spacing of the rails 26 such that the rail clamps 38 can be located on the cross-member 36 to align with the rails 26. The rail clamps 38 may be moveable side-to-side along the cross-member 36 to aid alignment with the rails 26 and/or to aid moving the rails 26/track 24 side-to-side into a desired alignment. In one embodiment, the arms 34 are aligned with the rails 26 and the rail clamps 38 are coupled to the arms 34. The arms 34 and/or the cross-member 36 may be armored to resist wear resulting from contact with a stream of ballast material 39 from the offloading conveyor 16.

Each of the rail clamps 38 may comprise available designs configured to engage the rail 26, such as by gripping a head of the rail 26, and preferably includes one or more rollers or bearings that enable the rail clamp 38 to move along the rail 26 without disengaging therefrom. As such, the rail clamp 38 can be engaged with the rails 26 and move along the rails 26 while the apparatus 10 moves forward along the tracks 24. The rail clamps 38 are sufficiently robust to lift the respective rails 26 along with the ties 28 coupled thereto.

Each of the rail clamps 38 is independently coupled to the cross-member 36 via an independent lifting means 40. The independent lifting means 40 enables each of the rail clamps 38 to be raised and lowered relative to the cross-member 36 independently and to different extents. This may allow engagement of the clamps 38 with rails 26 that are positioned at different heights, such as due to damage thereto. This also enables the rails 26 to be lifted and positioned at different heights during rehabilitation of the ballast material such as to provide a banked curve or the like.

The lifting means 40 may comprise a variety of actuators and/or mechanical linkages that may be manually or automatically operated. In one embodiment, the lifting means 40 comprises a winch mounted on the cross-member 36 with a cable coupled between the winch and the rail clamp 38. In another embodiment, the lifting means 40 comprise a hydraulic actuator coupled between the cross-member 36 and the rail clamp 38 or coupled to a mechanical linkage between the cross-member and the rail clamp 38.

With continued reference to FIGS. 1-4, operation of the apparatus 10 is now described in accordance with an exemplary embodiment. Initially, the apparatus 10 is coupled to a forward end of a ballast-delivery consist 21 and is moved adjacent to a section of tracks 24 in need of repair. In one embodiment, the apparatus 10 is employed for installation of new track 24 and/or for maintenance of the track 24. The arms 34 of the track-lifting unit 32 are pivoted to the lifting position to extend forward from the apparatus 10. The rail clamps 38 are lowered via their respective lifting means 40 and are coupled to the respective rails 26 in front of the apparatus 10. The lifting means 40 may be actuated to raise the respective rails 26 to desired vertical positions. In one embodiment, pivoting of one or both of the arms 34 may be employed to at least partially lift the rails 26 instead of or in addition to lifting by the lifting means 40.

The apparatus 10 is moved toward the damaged track 24. The displaced track 24 is drawn or lifted back into the desired position by engagement of the clamps 38 with the rails 26. A stream of ballast 39 is provided by the offloading conveyor 16 in front of the apparatus 10. The rate of deposition of ballast material and the rate of forward travel of the apparatus 10 may be controlled by an operator in the power and control unit 12 or remotely. The stream of ballast 39 may be directed side-to-side by rotation of the offloading conveyor 16 by the operator in order to provide desired coverage across the width of the ties 28. The deposited ballast material may also be spread side-to-side by the plow 30 as the apparatus 10 travels over the deposited ballast. The plow 30 may be pivotally mounted to a frame of the apparatus and controllable to control the spreading of the ballast.

The arms 34 have sufficient length to extend beyond a forward extent of a stream of ballast 39 provided by the offloading conveyor 16 to avoid damage from contact therebetween. The length of the arms 34 and the forward extent of the stream of ballast 39 relative to the apparatus 10 is also sufficient to enable the tracks 24 to be sufficiently rehabilitated to support the apparatus 10 as it moves onto the rehabilitated tracks 24.

Additional components may be installed on the arms 34, the cross-member 36, and/or the apparatus 10 generally to aid rehabilitation of the tracks 24 and/or deposition, spreading, and consolidating of the ballast material. For example, vibrating or shaking means configured to vibrate or shake the tracks 24 or ballast material to aid consolidation of the ballast material beneath the tracks 24 or tamping means configured to compact the ballast material may be employed.

Upon completion of rehabilitation of a section of track 24, the clamps 38 may be disengaged from the rails 26 and be fully retracted by the lifting means 40. The arms 34 may be pivoted to the stowed position and the apparatus 10 moved to a next location in need of repair. When rail lifting is not required the apparatus 10 may be operated similarly to known ballast delivery apparatus for common ballast delivery operations, but with the track-lifting unit 32 in the stowed position. The track-lifting unit 32 is configured to allow such operations to continue without hindrance.

Figure 7:
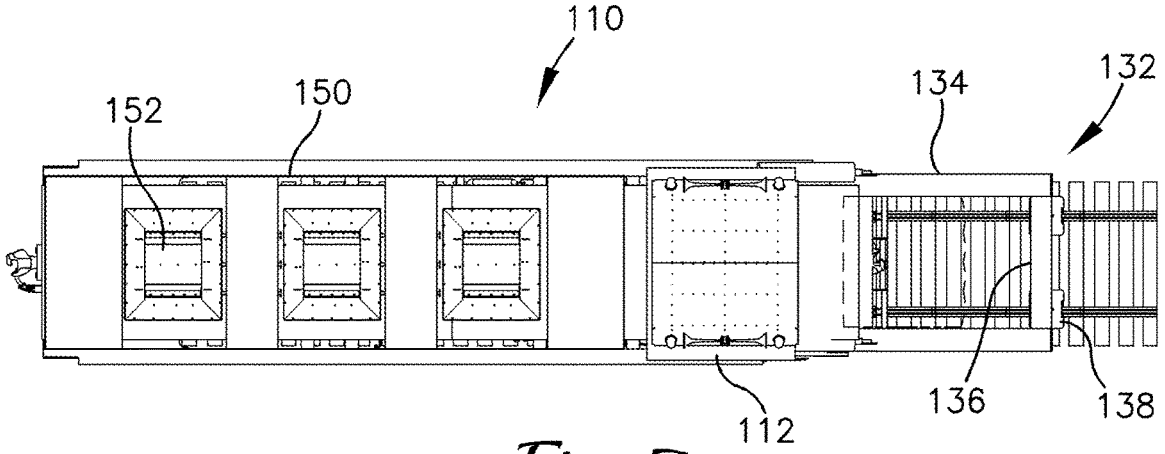
FIG. 7 is a top plan view of the apparatus of FIG. 6.
Figure 8:
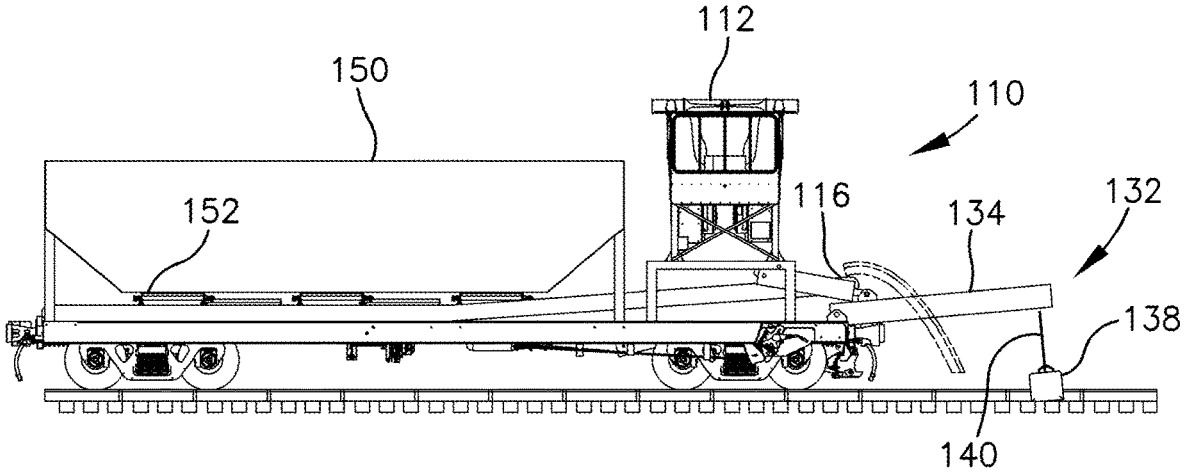
FIG. 8 is a side elevational view of the apparatus of FIG. 6.
Figure 9:
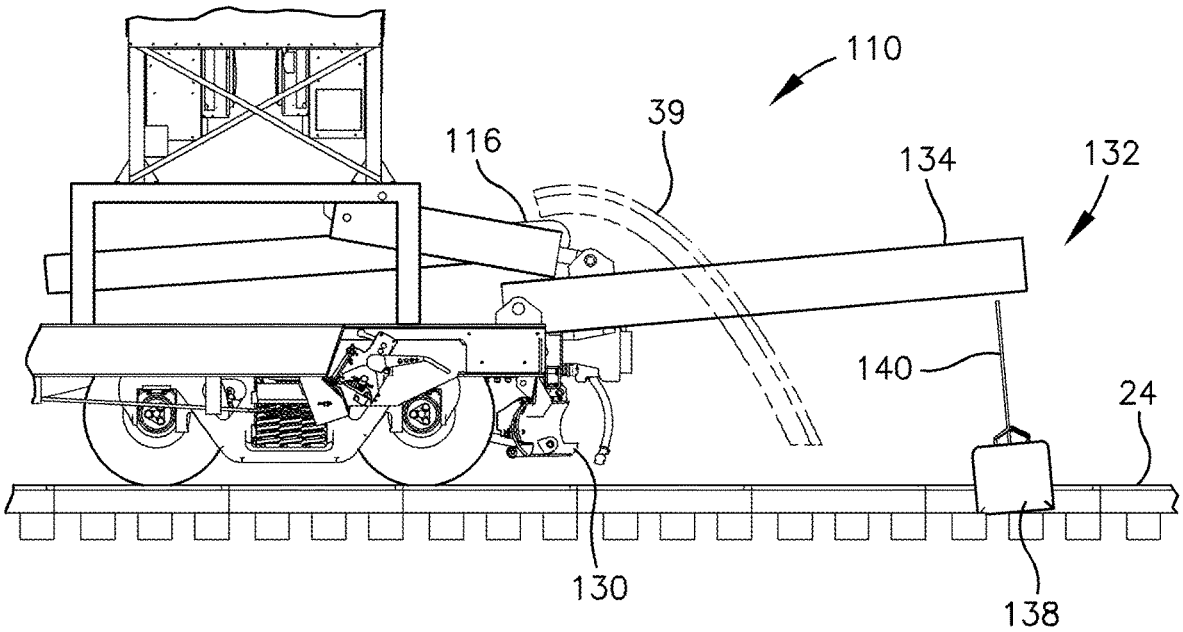
FIG. 9 is an enlarged, partial, side elevational view of apparatus of FIG. 6.
Figure 10:
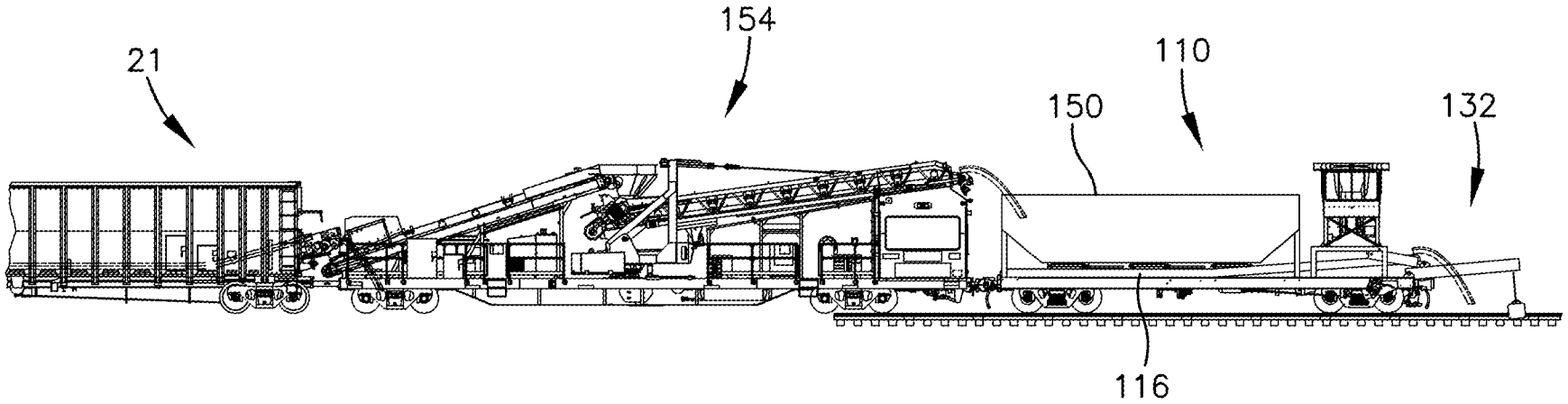
FIG. 10 is a side elevational view of the apparatus of FIG. 6. coupled to a forward end of a ballast-delivery consist.

With reference now to FIGS. 5-10, a track-lifting and ballast-spreading apparatus 110 is described in accordance with an exemplary embodiment. The apparatus 110 includes many of the same features as the apparatus 10. As such, only the additional or different features are described in detail here. The apparatus 110 includes an offloading conveyor 116 disposed to extend along a longitudinal length of the apparatus 110 beneath a hopper or surge bin 150 that includes a plurality of gates 152. As best seen in FIG. 7 the offloading conveyor 116 may be configured with an oversized width that is nearly as wide as a spacing between the rails 26 or that is as wide or wider than the rail spacing (for example about eighty-four inches). As such, the stream of ballast material 39 provided by the conveyor 116 may be deposited and spread across the width of the space between the rails 26 or more preferably across the width of the ties 28. In one embodiment, the conveyor 116 comprises a plurality of conveyors disposed side-by-side across the width of the apparatus 110. In another embodiment, the conveyor 116 comprises a plurality of conveyors that partially overlap one another across the width of the apparatus 110 and/or that include discharge end portions that are directed in different directions, i.e. one may be directed forward while a conveyor to each side thereof may be directed outwardly toward their respective side of the tracks 24. In another embodiment, one or more baffles, chutes, or other flow directing means are provided at the discharge end of the conveyor 116 to direct the stream or streams of ballast material 39.

The surge bin 150 is configured to be fed by a known ballast-delivery apparatus, such as the ballast-delivery apparatus. In one embodiment, the ballast-delivery apparatus feeding the surge bin 150 is configured similarly to the apparatus 10 but without the track-lifting unit 32. The ballast-delivery apparatus is disposed between the apparatus 110 and a ballast-delivery consist 21 and transports ballast materials from the consist 21 to the surge bin 150 of the apparatus 110 by means known in the art.

The surge bin 150 is configured to receive ballast from the ballast-delivery apparatus at a first flow rate and to distribute the ballast onto the conveyor 116 at a second flow rate that is greater than the first flow rate. For example, the second flow rate may be equal to or greater than about twice that of the first flow rate. In one embodiment, the second flow rate is about three thousand to about four thousand tons of ballast material per hour. Such increased flow rate enables the track-lifting and ballast-spreading apparatus 110, and the entire consist to which it is coupled, to sufficiently distribute a desired quantity of ballast material while moving along the track 24 at an increased speed over that possible using the first flow rate provided by the ballast-delivery apparatus.

The gates 152 of the surge bin 150 may be independently operable to control a flow rate from the surge bin 150 onto the conveyor 116 and thus the flow rate of the stream of ballast 39. The gates 152 may be enlarged compared to standard gates to increase the width of the discharge therefrom and thus the width of the stream of ballast material on the conveyor 116 and discharged thereby. The gates 152 might also be staggered or positioned at different locations across the width of the conveyor 116 to spread the ballast material across the width of the conveyor 116. In one embodiment, one or more baffles are employed to direct flow of ballast material from the gates 152 across the width of the conveyor 116.

Like the apparatus 10, the apparatus 110 also includes a track-lifting unit 132 comprised of a pair of arms 134, a cross-member 136, and a rail clamp assembly comprising a pair of rail clamps 138 coupled thereto. The track-lifting unit 132 is pivotable between stowed and lifting positions and the rail clamps 138 are extendable from the cross-member 136 as described above with respect to the apparatus 10. The track-lifting unit 132 is positioned and supported on the apparatus 110 such that the arms 134 and any associated components are sufficiently supported to distribute loads associated with lifting of the tracks 24. In some embodiments, the weight of the surge bin 150 may be employed to provide additional counterbalance against the lifting forces.

In operation, the apparatus 110 operates similarly to the apparatus 10. The arms 134 of the track-lifting unit 132 are pivoted downward to the lifting position and the rail clamps 138 are coupled to the rails 26 and lifted either by lifting the arms 134 or lifting the rail clamps 138 relative to the arms 134 to lift the rails 26 into a desired position. The ballast material is allowed to flow onto the conveyor 116 beneath the surge bin 150 through one or more of the gates 152. The ballast material is conveyed beneath the power and control unit 112 and is discharged from the conveyor and deposited onto the track in front of the apparatus 110 by the conveyor 116. Conveyance and deposition of the ballast material from below the power and control unit 112 provides increased visibility for the operator compared to that available, for example, in configurations like that of the apparatus 10 where the ballast material is deposited from above the power and control unit 12 and passes between the operator and the rail clamps 38.

The stream of ballast 139 provided by the conveyor 116 is preferably as wide as the ties 28, or as wide as the spacing between the rails 26, such that side-to-side movement of the conveyor 116 is not necessary. The plow 130 may aid to further spread the deposited ballast toward ends of the ties 28 as the apparatus 110 travels over the deposited ballast material. Like the apparatus 10, when rail lifting is not needed, the apparatus 110 may remain coupled with the ballast-delivery apparatus and the consist 21 while the ballast-delivery apparatus carries out common ballast delivery operations without hindering those operations. The apparatus 110 may also be employed to aid ballast delivery operations when lifting of the track 24 is not needed.

Referring now to FIGS. 11-15, a track-lifting and ballast-spreading apparatus 210 is described in accordance with another exemplary embodiment. The apparatus 210 is comprised of a pair of rail cars 256 on which a surge bin 250 is disposed on a rearward one of the cars 256 and a track-lifting unit 232 is disposed on a forward one of the cars 256. In some embodiments, the apparatus 210 includes one or more additional rail cars 256 that each includes one or more additional surge bins 250 configured to receive a flow of ballast material from a rearwardly positioned car 256 or surge bin 250 thereon or from the ballast-delivery apparatus and to distribute the ballast material forward and/or onto a discharge conveyor 216.

Figure 16:
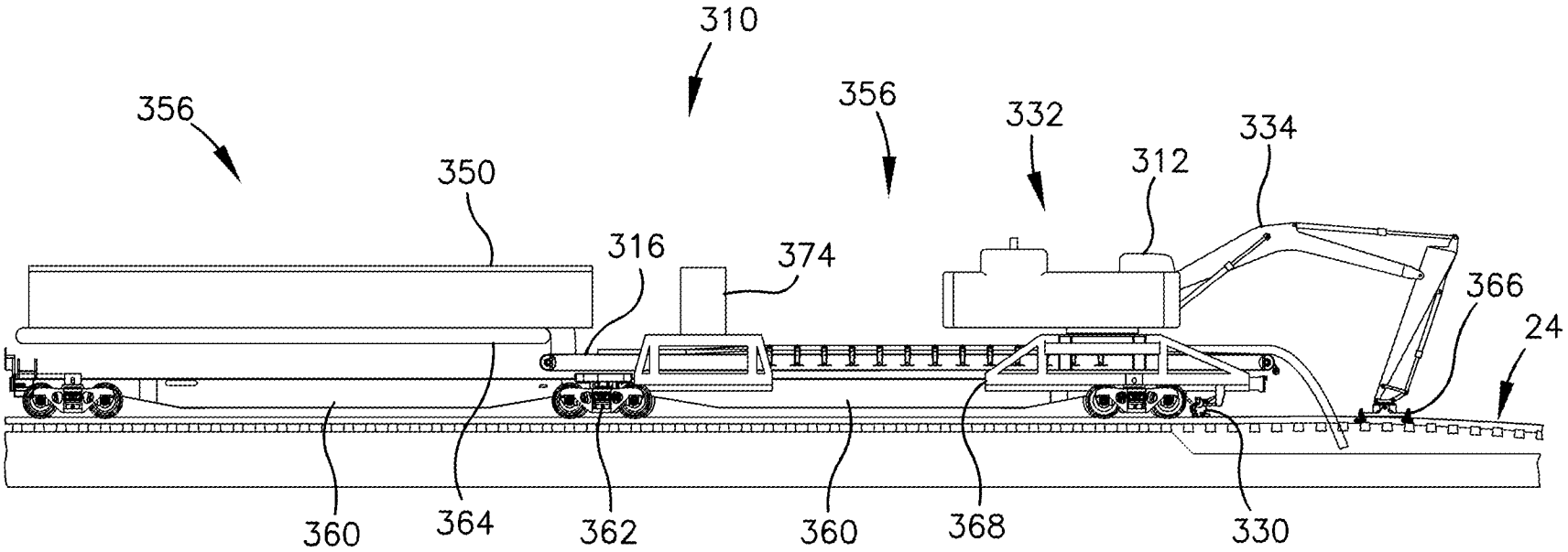
FIG. 16 is a side elevational view of a track-lifting and ballast-spreading apparatus with a shared-truck configuration depicted in accordance with an exemplary embodiment.

Each of the cars 256 may be constructed as a spine car-style body in which a body 257 of the car generally comprises a narrow box-beam, I-beam, or similar structure extending end to end. The cars 256 may alternatively be constructed on a body 257 having a flat-bed-style, gondola-style, or may comprise a modified box car among a variety of other available configurations. Each car 256 is supported at each end on a dedicated truck 258. Alternatively, as depicted in FIG. 16, an articulated car configuration may be employed in which a track-lifting and ballast-spreading apparatus 310 is formed from a plurality of car bodies or segments 360 pivotably coupled together on shared trucks 362 disposed at adjacent ends of the segments 360.

The surge bin 250 includes a live bottom in which a bin-conveyor 264 forms a bottom wall of the surge bin 250 and a flow rate of the ballast material from the surge bin 250 is controlled by the speed of the bin-conveyor 264. The surge bin 250 might alternatively be configured like the surge bin 150 to include a plurality of gates or similar structures for controlling a rate of flow of the ballast material onto the bin-conveyor 264, among other configurations. The bin-conveyor 264 thus carries the ballast material from the surge bin 250 to the discharge conveyor 216. The bin-conveyor 264 and the discharge conveyor 216 may overlap and/or may include one or more transitions or chutes therebetween to direct the ballast material onto the discharge conveyor 216. The overlap between the bin-conveyor 264 and the discharge conveyor 216 and any transitions therebetween may be configured to maintain the flow of ballast material from the bin-conveyor 264 onto the discharging conveyor 216 as the conveyors 264, 216 pivot with respect to one another, such as when the apparatus 210 is traversing a curved section of the tracks 24 (FIG. 12).

Figure 11:
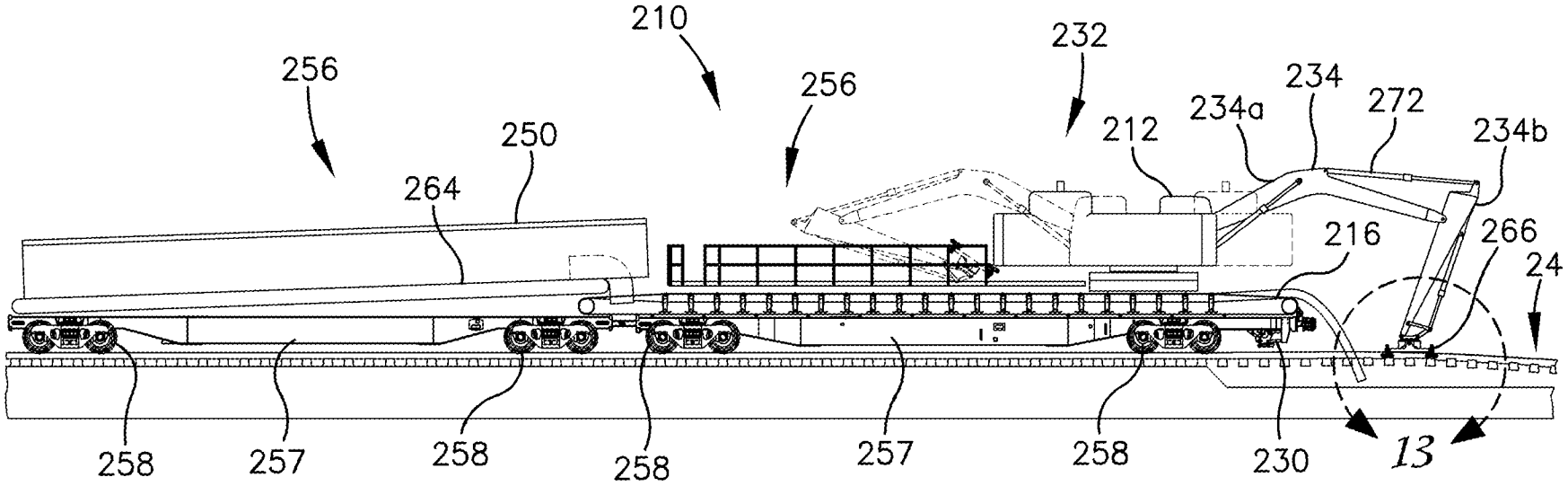
FIG. 11 is a side elevational view of a track-lifting and ballast-spreading apparatus depicted in accordance with another exemplary embodiment.
Figure 12:
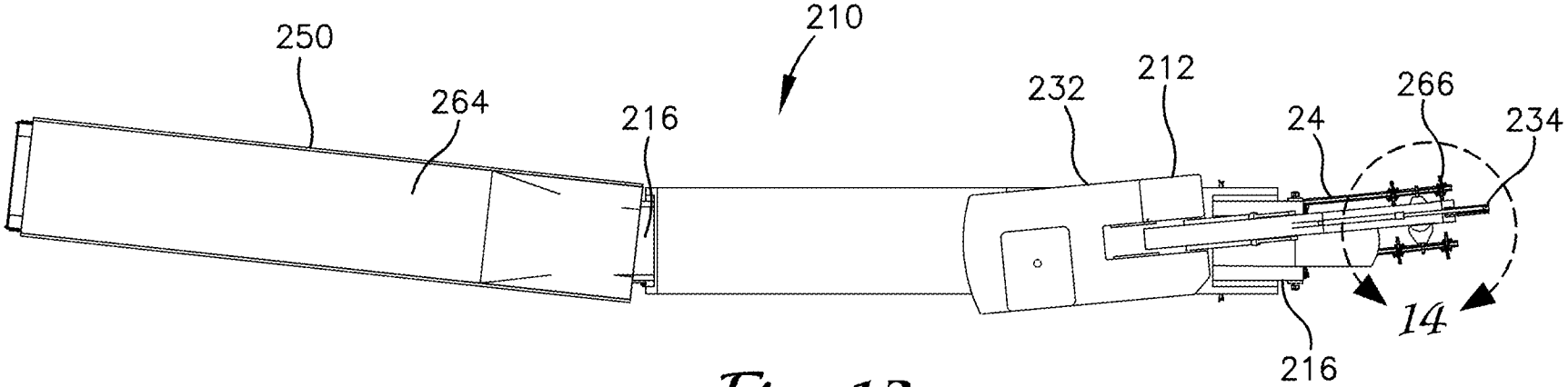
FIG. 12 is a top plan view of the apparatus of FIG. 11 depicted on a curved section of track.

As depicted in FIGS. 11-12, the track-lifting unit 232 includes a single, articulated, telescopic, or otherwise extensible boom or arm 234 with a rail clamp assembly 266 or end-arm-tool disposed at a distal end thereof. In the embodiment depicted in FIGS. 11-15, the arm 234 comprises one or more segments 234*a*, 234*b* that are pivotably connected to enable pivotable movement and thus extension/retraction of the rail clamp assembly 266. In another embodiment, the arm 234 might also or alternatively include one or more telescopic portions to aid extension/retraction.

The arm 234 is pivotably coupled to a power and control unit 212 which is pivotally or rotatably mounted on forwardmost car 256 to enable pivoting of the arm 234 vertically and/or side-to-side. Such movements enable raising or lowering of the arm 234 and the rail clamp assembly 266 on the distal end thereof during operation of the apparatus 210 and for positioning the arm 234 in an operational position and a transit position. In the operational position the arm 234 extends forward from the car 256, as depicted in FIGS. 11-12, and in the transit position the arm 234 extends rearwardly over the body 257 of the car 256 for transportation of the apparatus 210, as depicted in phantom lines in FIG. 11. In the transit position, the arm 234 may be folded or otherwise retracted to minimize the space occupied thereby and/or to minimize the overall height of the car 256 for travel under low-clearance obstacles, such as bridges and tunnels.

The power and control unit 212 to which the arm 234 is coupled may be rotatable about a vertical axis to enable rotation of the power and control unit 212 and the arm 234 side-to-side up to and including 180 or fully and/or infinitely rotatable. Such rotation enables the arm 234 to be moved or rotated side-to-side between the operational and transit positions. The power and control unit 212 includes a body that houses components such as hydraulic pumps, generators, actuators, and motors, among other components used in operation of the apparatus 210. The power and control unit 212 may be operated remotely or include an operator's station or cab in which an operator may sit to control operation of the power and control unit 212, the arm 234, and the conveyors 216 and 264 and conveyors of a ballast delivery consist feeding the surge bin 250 as well as forward or rearward movement of the entire apparatus 220. The power and control unit 212 may be positioned overlying or slightly rearward of the forward dedicated truck 258 and is sufficiently anchored and supported to handle forces applied on the apparatus 210 as the tracks 24 are lifted. Such forces may be distributed through the body 257 of the car 256 and/or rearwardly to one or more rearwardly adjacent cars 256 and may be counterbalanced, at least in part, by the weight of the surge bins 250.

In some embodiments, the track-lifting unit 232 is configured similarly to or may comprise a boom and body of an excavator unit, such as a Komatsu PC490LC excavator, from Komatsu America Corp. or similar unit of desired capabilities. In one embodiment, the boom and the power and control unit or body of an existing excavator unit may be disembodied from a track or base unit (i.e. a portion of the excavator including tracks or wheels on which the excavator can be moved) and coupled to a framework 368 of the car 356, similarly to that depicted in FIG. 16.

The framework 368 and/or the power and control unit 312 may be configured to enable vertical movement of the power and control unit 312. As such, the power and control unit 312 may be raised to the operational position and lowered to the transit position to further aid minimizing an overall height of the track-lifting unit 332.

Figure 13:
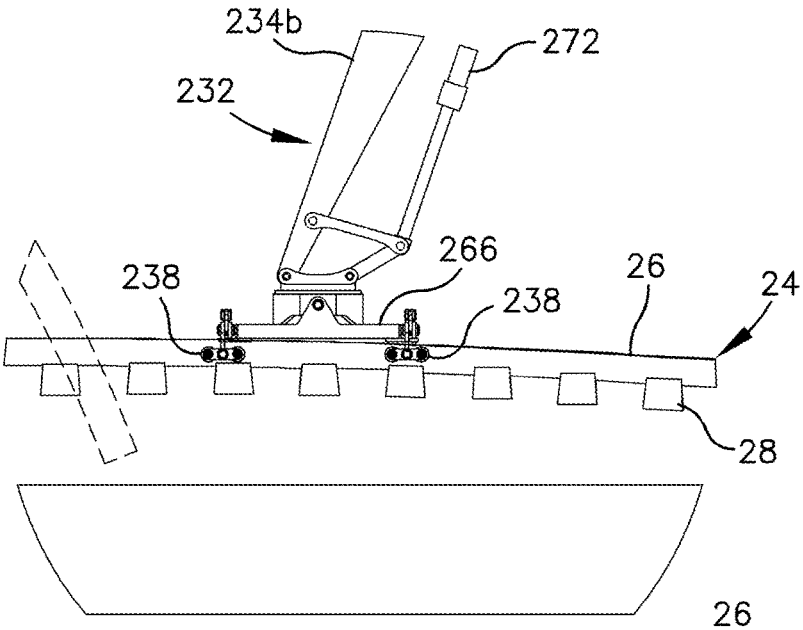
FIG. 13 is a partial enlarged view of an end-arm-tool depicted at 13 in FIG. 11.
Figure 14:
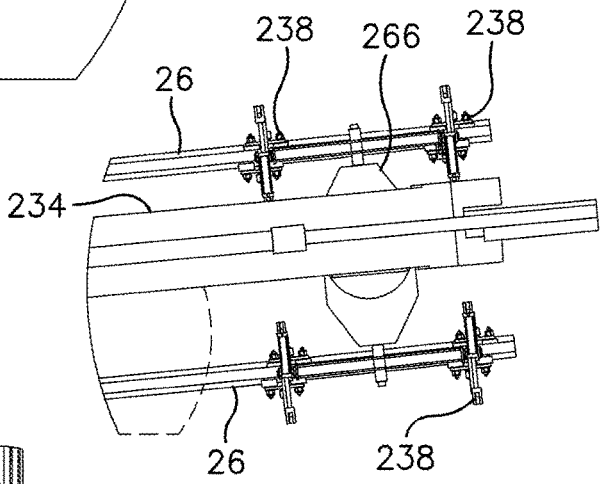
FIG. 14 is a partial enlarged view of an end-arm-tool depicted at 14 in FIG. 12.
Figure 15:
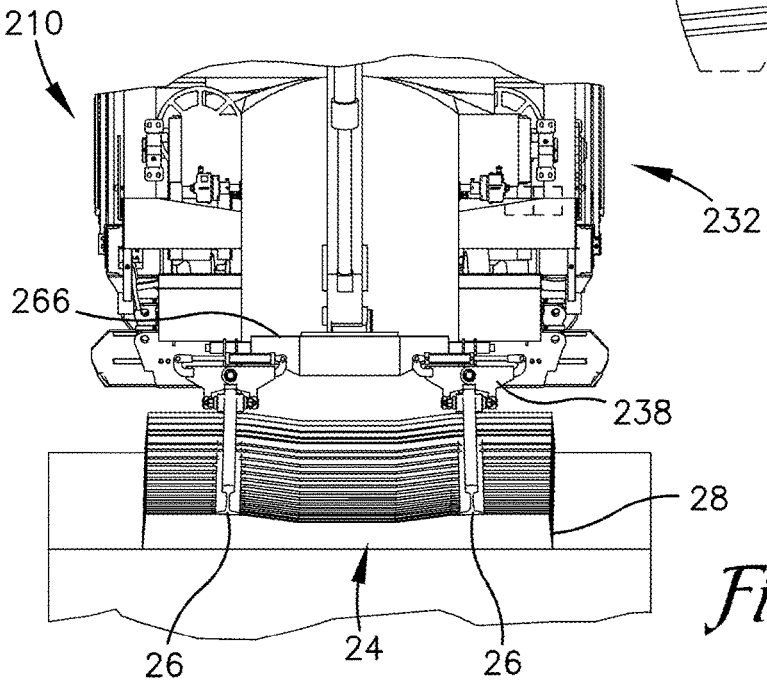
FIG. 15 is a partial, front-end, enlarged elevational view of the apparatus of FIG. 11.

The rail clamp assembly 266 may take a variety of configurations and preferably includes a structure or rig 270 that carries a plurality of rail clamps 238 which may be configured similarly to the rail clamps 38, 138 described previously. As depicted in FIGS. 13-15, in one embodiment the rail clamp assembly 266 includes four rail clamps 238 which are spaced apart transversely such that two of the rail clamps 238 are positioned to engage each rail 26. The rail clamps 238 may also be spaced apart longitudinally along the rails 26. Such longitudinal spacing may aid traversing obstructions on the rails 26, such as joint bars or the like without need to fully disengage the rail clamp assembly 266 from the rails 26.

The rail clamp assembly 266 may be pivotable forward/aft, side-to-side, and/or rotatable to enable manipulation of the tracks 24 on which the rail clamp assembly 266 is engaged. The tracks 24 may thus be cross-leveled or placed on a desired angle, such as banked along a curve, during operations of the track-lifting unit 232.

The car 256 preferably carries one or more hydraulic pumps, generators, and the like to provide power to the apparatus 210 and its various components. As described previously, such pumps, generators, and the like may be disposed in the body of track-lifting unit 232, such as within the power and control unit 212. As depicted in FIG. 16, in one embodiment, a generator 374 as well as any other desired pumps or the like may be provided on the car 356 on a dedicated structure and separate from the track-lifting unit 232 and the power and control unit 312, as depicted in FIG. 16.

Movements of the arm 234, the power and control unit 212, and the rail clamp assembly 266 may be provided by one or more hydraulic actuators 272 powered by the hydraulic pumps disposed in the power and control unit 212. In some embodiments, the arm 234, the power and control unit 212, and rail clamp assembly 266 may employ one or more of electric, mechanical, or pneumatic actuators in addition to or instead of hydraulic actuators.

With continued reference to FIGS. 11-15, operation of the track-lifting and ballast spreading apparatus 210 is described in accordance with an exemplary embodiment. The apparatus 210 is coupled to a forward end of a ballast-delivery consist, such as the ballast-delivery consist 21. The ballast-delivery consist, which may include a ballast-delivery apparatus, deposits ballast material into the surge bin 250 at a first rate (as described previously above). Filling of the surge bin 250 is carried out generally continuously during operation of the apparatus 210 up to a desired fill level of the surge bin 250.

The ballast-delivery and rail-lifting apparatus 210 along with the ballast-delivery consist is moved to a location along the tracks 24 in which ballast material is desired to be deposited, such as where the track 24 is in need of rehabilitation from damage or where an initial rough in of a new track installation is desired. The track-lifting unit 232 is moved from the transit position to the operational position. To do so, the arm 234 is raised above the base of the car 256 and pivoted to a desired position. The track-lifting unit 232, including the arm 234 and the power and control unit 212 are rotated to move the arm 234 to extend forwardly from the car 256. The arm 234 is pivoted to appropriately position the rail clamp assembly 266 over the tracks 24 and the rail clamps 238 are engaged with their respective rails 26. The arm 234 then raises the track 24 into a desired position and the rail clamp assembly 266 may be manipulated to cross-level or otherwise orient the track 24 as desired.

The apparatus 210 and the ballast-delivery consist 21 are moved forward along the tracks 24 toward and onto areas of the track 24 needing ballast deposition. The rail clamps 238 travel along the rails 26 while maintaining engagement therewith, thereby continuously raising the track 24 into the desired position as the apparatus 210 is moved forward. Ballast material from the surge bin 250 is disposed onto the discharge conveyor 216 which transports the ballast material along the apparatus 210, beneath the power and control unit 212 or body thereof, and deposits the ballast material in front of the car 256 between the forward end of the car 256 and the rail clamp assembly 266. The ballast material is thus distributed onto and through the raised tracks 24 to flow around the rails 26 and the ties 28 and into position beneath and around the raised tracks 24.

Deposition of the ballast material onto and through the tracks 24 is provided by the discharge conveyor 216 at a second flow rate which is greater than the first flow rate of ballast material received from the ballast-delivery consist—preferably about three to about four thousand tons per hour which may be about twice the first flow rate. Make-up of the difference in ballast material provided by the ballast-delivery consist 21 at the first flow rate and ballast material deposited by the discharge conveyor 216 at the second flow rate may be provided through generally continuous operation of the ballast-delivery consist while operation of the discharge conveyor 216 may be discontinuous. Other operations and activities at a track-rehabilitation/installation site often necessitate halting of ballast deposition for short times. Such halting of the ballast deposition provides time in which the ballast-delivery consist can catch up on filling the surge bin 250. Additionally, a plurality of surge bins 250 may be employed to provide a larger reservoir or accumulation of available ballast material for deposition by the discharge conveyor 216.

The discharge conveyor 216 also preferably provides a stream of ballast material that is as wide or wider than the spacing between the rails 26. In one embodiment the stream of ballast is between about five and about seven feet wide or is nearly as wide as the transverse length of the ties 28 or about eight to about 8.5 feet wide or wider.

A plow 230 is lowered from the front end of the car 256. As the apparatus 210 is driven forward, the plow 230, which may be pivoted to a desired angle aids to spread the deposited ballast material which may be heaped or piled somewhat in the center of the tracks 24, across the width of the tracks 24 and aids to remove ballast material from the tops of the rails 26.

Accordingly, the apparatus 210 independently raises and supports track 24 while depositing ballast material which flows beneath the raised track 24. The apparatus 210 then moves onto and over track 24 that it has rehabilitated while continuing to raise and rehabilitate the track 24 further ahead. Additionally, the rate of deposition of the ballast material by the discharge conveyor 216 (i.e. the second rate) enables an increased rate of travel of the apparatus 210. This not only decreases repair time but also eases operation of propulsion means for the ballast-delivery consist 21, because such propulsion means may have a minimum speed at which it can operate.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

What is claimed is:

1. A track-lifting and ballast-spreading apparatus comprising:

a car body supported on a forward truck and a rearward truck configured to travel along a railway;

a track-lifting unit disposed on the car body near the forward truck, the track-lifting unit including an arm that is extendable beyond a forward end of the car body to an operational position and retractable to a transit position in which the arm substantially overlies the car body;

a rail clamp assembly disposed at a distal end of the arm and configured to couple to one or both rails of a section of track to be lifted and to be moveable longitudinally along the rails while maintaining the track in a raised position; and a conveyor disposed on the car body and configured to distribute ballast material between the forward end of the car body and the rail clamp assembly when the arm is in the operational position and the rail clamp assembly is coupled to the one or both rails.

2. The track-lifting and ballast-spreading apparatus of claim 1, wherein the arm is pivotable between the operational position and the transit position.

3. The track-lifting and ballast-spreading apparatus of claim 1, wherein the arm is at least partially telescopically moveable between the operational position and the transit position.

4. The track-lifting and ballast-spreading apparatus of claim 1, wherein the conveyor is disposed on the car body and passes between the car body and the track-lifting unit.

5. The track-lifting and ballast-spreading apparatus of claim 1, further comprising:

a surge bin configured to receive a flow of a ballast material from a ballast-delivery consist and to distribute the ballast material onto the conveyor.

6. The track-lifting and ballast-spreading apparatus of claim 5, wherein the flow of the ballast material from the ballast-delivery consist is received at a first flow rate and the surge bin distributes the ballast material onto the conveyor at a second flow rate that is greater than the first flow rate.

7. The track-lifting and ballast-spreading apparatus of claim 6, wherein the second flow rate is greater than about three thousand tons of ballast material per hour.

8. The track-lifting and ballast-spreading apparatus of claim 1, wherein the conveyor has a width that is equal to or greater than a spacing between the rails of the track.

9. The track-lifting and ballast-spreading apparatus of claim 1, wherein the track-lifting unit is moveable vertically between the operational position and the transit position, the track-lifting unit having a lower overall height when in the transit position.

10. The track-lifting and ballast-spreading apparatus of claim 1, wherein the track-lifting unit is rotatable about a vertical axis, and wherein the track-lifting unit is rotated about the axis to move the arm from the operational position in which the arm extends forwardly and the transit position in which the arm extends rearwardly.

11. The track-lifting and ballast-spreading apparatus of claim 1, wherein the car body comprises a forward section and a rearward section that are pivotably coupled at and supported on a shared truck.

12. The track-lifting and ballast-spreading apparatus of claim 1, wherein the rail clamp assembly is pivotable to adjust an orientation of the track.

13. A method for distributing ballast material around tracks of a railway, the method comprising:

providing a track-lifting and ballast-spreading apparatus coupled to a forward end of a ballast-delivery consist on tracks of a railway in need of ballast material, the apparatus including a track-lifting unit with an arm, a surge bin that receives ballast material from the ballast-delivery consist, and a conveyor that receives the ballast material from the surge bin and conveys the ballast material forwardly along the apparatus;

engaging one or a plurality of rail clamps disposed at a distal end of the arm with one or both rails of the track, the arm being positioned to extend forwardly along the tracks from the track-lifting unit and the one or a plurality of rail clamps engaging one or both of the rails in front of the apparatus;

pivoting the arm vertically by the track-lifting unit to lift the track to a desired raised position;

depositing the ballast material in front of the apparatus by the conveyor while the track is lifted and held in the raised position, the ballast material being distributed onto the now raised track to flow below and around the raised track; and moving the apparatus forwardly along the tracks while maintaining the track in the raised position, the one or plurality of rail clamps maintaining the engagement with the one or both rails and moving forwardly along the one or both rails, the apparatus moving onto and over the raised track and the ballast material that has been deposited.

14. The method of claim 13, further comprising:

moving the arm from a transit position in which the arm substantially overlies a body of a car of the apparatus to an operational position in which the arm extends forwardly beyond a forward end of the body of the car.

15. The method of claim 14, wherein moving the arm from the transit position to the operational position further comprises:

rotating the track-lifting unit about a vertical axis between the transit position and the operational position.

16. The method of claim 13, further comprising:

receiving the ballast material in the surge bin from the ballast-delivery consist at a first flow rate; and depositing the ballast material from the surge bin onto the conveyor at a second flow rate that is greater than the first flow rate.

17. The method of claim 16, wherein the second flow rate is equal to or greater than twice the first flow rate.

18. The method of claim 13, wherein the one or plurality of rail clamps is disposed on a rail clamp assembly coupled to the distal end of the arm, and wherein the method further comprises:

pivoting the rail clamp assembly to position the rails in a desired level or banked orientation relative to one another.

19. A track-lifting and ballast-spreading apparatus comprising:

a car body supported on a forward truck and a rearward truck configured to travel along a railway;

a track-lifting unit disposed on the car body near the forward truck, the track-lifting unit including an arm that is extendable beyond a forward end of the car body to an operational position and retractable to a transit position in which the arm extends rearwardly and substantially overlies the car body, the track-lifting unit being rotatable about a vertical axis to move the arm between the operational position and the transit position;

first and second rail clamps disposed at a distal end of the arm and coupleable to first and second rails respectively of a section of track to be lifted to a raised position and the first and second rail clamps being moveable longitudinally along the rails while maintaining the track in the raised position;

a surge bin that receives a flow of a ballast material from a ballast-delivery consist; and a conveyor disposed on the car body that receives the ballast material from the surge bin and distributes the ballast material between the forward end of the car body and the first and second rail clamps while the track is lifted to the raised position.

20. The track-lifting and ballast-spreading apparatus of claim 19, wherein the flow of the ballast material from the ballast-delivery consist is received at a first flow rate and the conveyor distributes the ballast material at a second flow rate that is greater than the first flow rate.

* * * * *